US006556797B1

(12) United States Patent
Nishigaki et al.

(10) Patent No.: US 6,556,797 B1
(45) Date of Patent: Apr. 29, 2003

(54) IMAGE-FORMING APPARATUS

(75) Inventors: Makoto Nishigaki, Odawara (JP); Atsushi Sano, Shizuoka-ken (JP); Masahiko Ijuin, Tokyo (JP); Toshikazu Kobayashi, Kawachi-machi (JP)

(73) Assignees: Canon Kabushiki Kaisha, Tokyo (JP); Du Pont Kabushiki Kaisha, Tokyo (JP)

( * ) Notice: Subject to any disclaimer, the term of this patent is extended or adjusted under 35 U.S.C. 154(b) by 33 days.

(21) Appl. No.: 09/627,443

(22) Filed: Jul. 27, 2000

(30) Foreign Application Priority Data

Jul. 30, 1999 (JP) ..... 11-217409

(51) Int. Cl.[7] ..... G03G 15/00

(52) U.S. Cl. ..... 399/130; 399/66; 399/67; 399/68; 399/69

(58) Field of Search ..... 399/130, 66, 67, 399/68, 69

(56) References Cited

U.S. PATENT DOCUMENTS 6,207,236 B1 * 3/2001 Araki ..... 427/386

* cited by examiner

*Primary Examiner*—Edward J. Cain
(74) *Attorney, Agent, or Firm*—Fitzpatrick, Cella, Harper & Scinto

(57) ABSTRACT

An image-forming apparatus is disclosed in which, using a photosensitive member and a toner, an unfixed image of the toner is formed on a transfer medium and the unfixed image on the transfer medium is fixed by a heat-and-pressure fixing means. In the image-forming apparatus, a delivery guide member, which guides the delivery of the transfer medium and is placed close to the heat and pressure fixing means, has a value of triboelectric voltage not greater than 500 V as measured by the triboelectric voltage measuring method according to JIS L1094B.

10 Claims, 3 Drawing Sheets

IMAGE-FORMING APPARATUS

BACKGROUND OF THE INVENTION

1. Field of the Invention

This invention relates to an image-forming apparatus, such as a copying machine or a printer, which employs an electrophotographic process.

2. Related Background Art

Printers employing an electrophotographic process are conventionally constructed as shown in FIG. 1.

A paper feed cassette 2 is set at the lower part of the main body 1 of a printer, and sheet material P is loaded into a sheet loading board 201. With regard to the sheet materials P, a pick-up roller 202 is driven by a main motor (not shown) and rotated in the direction of an arrow A, whereby the sheet material P is sheet-by-sheet delivered to twin paper feed rollers 203 consisting of a paper feed roller 203*a* and a retard roller 203. The uppermost sheet material P is separated then fed to first twin delivery rollers 301 consisting of a first delivery roller 301*a* and a support roller 301*b*. The sheet material P delivered to the first twin delivery rollers 301 is delivered to second twin delivery rollers 302 consisting of a second delivery roller 302*a* and a support roller 302*b*, and is further delivered to a transfer zone formed by a transfer photosensitive member 401 and a transfer roller 402 which are held in a cartridge 4. At the transfer zone, image signals processed by a controller (not shown) are written as an electrostatic latent image on the transfer photosensitive member 401 by means of a scanner 5. The electrostatic latent image is developed with a toner, and thereafter the developed image is transferred to the sheet material P as an unfixed image.

The sheet material P to which the unfixed image has been transferred is delivered through a transport guide 403 to a fixing assembly 6. In the fixing assembly 6, a heater unit 601 consists of a ceramic heater 601*a*, a fixing film 601*b*, a film guide 601*c* and a stay 601*d*. Upon applying an alternating current, the ceramic heater 601*a* heats the fixing film 601*b*, and a pressure roller 602 applies a stated pressure, thus the unfixed image on the sheet material P delivered there is fixed. The sheet material P having the image thus fixed is delivered to first twin paper-output rollers 603 consisting of a first paper-output roller 603*a* and a paper-output support roller 603*b*.

In the case of double-side printing, a flap 14 moves upward to the position shown by dotted lines, and the sheet material P to which the unfixed image has been fixed is delivered to twin reversible rollers 801 of a double-side unit 8; the rollers 801 consisting of an reversible roller 801*a* which rotates in the direction of an arrow D and an reversible support roller 801*b*. Then, the sheet material P is sent to a delivery path 807. The rotation of the reversible roller 801 is switched to the direction of an arrow E, so that the sheet material P delivered to the delivery path 807 by a predetermined length is delivered to a delivery path 808, and then sent on to first twin double-side-printing delivery rollers 803 consisting of a first double-side-printing delivery roller 803*a* and a support roller 803*b* and to second twin double-side-printing delivery rollers 804 consisting of a second double-side-printing delivery roller 804*a* and a support roller 804*b*.

Thereafter, at given timing, the sheet material P is again delivered to the first twin delivery rollers 301 and the second twin delivery rollers 302, and, at the transfer zone formed by the transfer photosensitive member 401 and the transfer roller 402, an unfixed image is transferred to the second-side surface which is the back of the first-side surface, in like manner on the first-side. surface.

The sheet material P to which the unfixed image on the second-side surface has been transferred is again delivered through the transport guide 403 to the fixing assembly 6, where the unfixed image on the second-side surface is fixed, and the sheet material P having the having the image thus fixed on the second-side surface is delivered to the first twin paper-output rollers 603. After the fixing on the second-side surface, the flap 14 stands on the position shown by solid lines, and the sheet material P is delivered to second twin paper-output rollers 701 consisting of a second paper-output roller 701*a* and a paper-output support roller 701*b*, and discharged on a face-down tray 702.

A detailed construction of the fixing assembly 6 is shown in FIG. 2.

On the downstream side of the heater unit 601 and pressure roller 602, provided are a lower guide 609 which guides the sheet material P to the first twin paper-output rollers 603 and an upper guide 612. Materials for the lower guide 609 and upper guide 612 are formed of a polymer composition (Type P) shown in Table 1.

Numerical values of the triboelectric voltage, surface resistivity and contact angle water repellency of the polymer composition (Type P) are shown in Table 2.

TABLE 1

| Type P | |
|---|---|
| Components | wt. % |
| Base polymer: PET | 53.5 |
| Ion-conductive polymer: none | 0.0 |
| Ion feed source: none | 0.0 |
| Plasticizer: polyethylene glycol 400 bis(2-ethyl hexanoate) | 1.5 |

Remainder ingredients: glass fiber, an antioxidant, a flame retardant, and an auxiliary flame retardant.

TABLE 2

| |
|---|
| Triboelectric voltage: 3,000 V |
| Surface resistivity: $7.8 \times 10^{16}$ Ω |
| Contact angle: 75° |

Triboelectric voltage is a value measured by the method prescribed in JIS L1094B.

However, the above prior art has disadvantages as stated below.

After the fixing on the fist-side surface, the toner image heat-fixed by the heater unit 601 and pressure roller 602 may adhere to the upper guide 12 before it solidifies completely onto the sheet material. Since the toner is very cohesive to each other, it may grow or accumulate gradually on the upper guide 612 every time the sheet material is delivered, so that the image on the sheet material delivered later may be scraped with the toner having accumulated on the upper guide, or the sheet material may run against the toner having accumulated on the same to cause a paper jam.

When the toner image is fixed on the second-side surface, the first-side surface is also heated because of the fixing on the second-side surface. Hence, the toner may likewise accumulate on the lower guide 609, and in addition image scraping and paper jamming may likewise occur as a result of the accumulation of the toner.

As a means for preventing the above-mentioned problems, a method is available in which the guide is coated on its surface with an ultraviolet-curing resin so that the toner does not adhere to the guide; the resin containing fluorine resin (such as PFA or ETFE) particles dispersed therein (hereinafter "UV coating"). This UV coating provides a contact angle of 100° or above, at which water repellency is exhibited, so that the toner does not adhere to the delivery guide surface.

However, a problem in the UV coating is that the UV coating itself results in a very high cost because the guide is produced through many steps of setting a guide member to a jig, coating it with a coating material, curing coatings with ultraviolet rays, controlling the coating layer thickness and so forth when the guide member is coated.

The UV coating has another problem that the coating film formed may wear gradually as a result of its contact friction with the sheet materials. To the part from which the UV-coating film has worn away, the toner tends to adhere, as in the case of the problems in the prior art. Once it has adhered, since the toner is very cohesive to each other, it may accumulate gradually on the part where the material (PET) of the guide member is laid bare, so that the leading end of the sheet material may be caught there to cause a paper jam.

As another problem, when the UV coating is applied on the guide member, an adhesive solvent is used to make it easy that the ultraviolet-curing resin to be coated, containing fluorine resin (such as PFA or ETFE) particles dispersed therein, adheres to the guide member. Hence, depending on materials (materials containing PC) for the guide member, the resin material may be attacked by the adhesive solvent to cause cracks in the guide member.

Also in view of recycling, there is such a problem that the resin provided with the UV coating is difficult to reuse.

SUMMARY OF THE INVENTION

Accordingly, an object of the present invention is especially to provide an image-forming apparatus in which its delivery guide member can be free from any deterioration in antistatic properties even as a result of its contact friction with the sheet materials and hence the toner does not accumulate on the delivery guide member to prevent any image scrape and paper jam from being caused by the accumulation of toner.

The present invention provides an image-forming apparatus in which, using a photosensitive member and a toner, an unfixed image of the toner is formed on a transfer medium and the unfixed image on the transfer medium is fixed by a heat-and-pressure fixing means, wherein;

a delivery guide member which guides the delivery of the transfer medium, positioned in the vicinity of the heat-and-pressure fixing means, has a value of triboelectric voltage not greater than 500 V as measured by the triboelectric voltage measuring method according to JIS L1094B.

In the present invention, the triboelectric voltage of the delivery guide member which is positioned in the vicinity of a heat-and-pressure fixing means of an image-forming apparatus and delivers the transfer medium is controlled. Thus, the unfixed toner image transferred to the transfer medium is kept from adhering to and accumulating on the delivery guide member, so that good images can stably be obtained in the image-forming apparatus without requiring any complicated process for producing the guide member and applying any special treatment that makes its reuse difficult.

DESCRIPTION OF THE PREFERRED EMBODIMENTS

Figure 1:
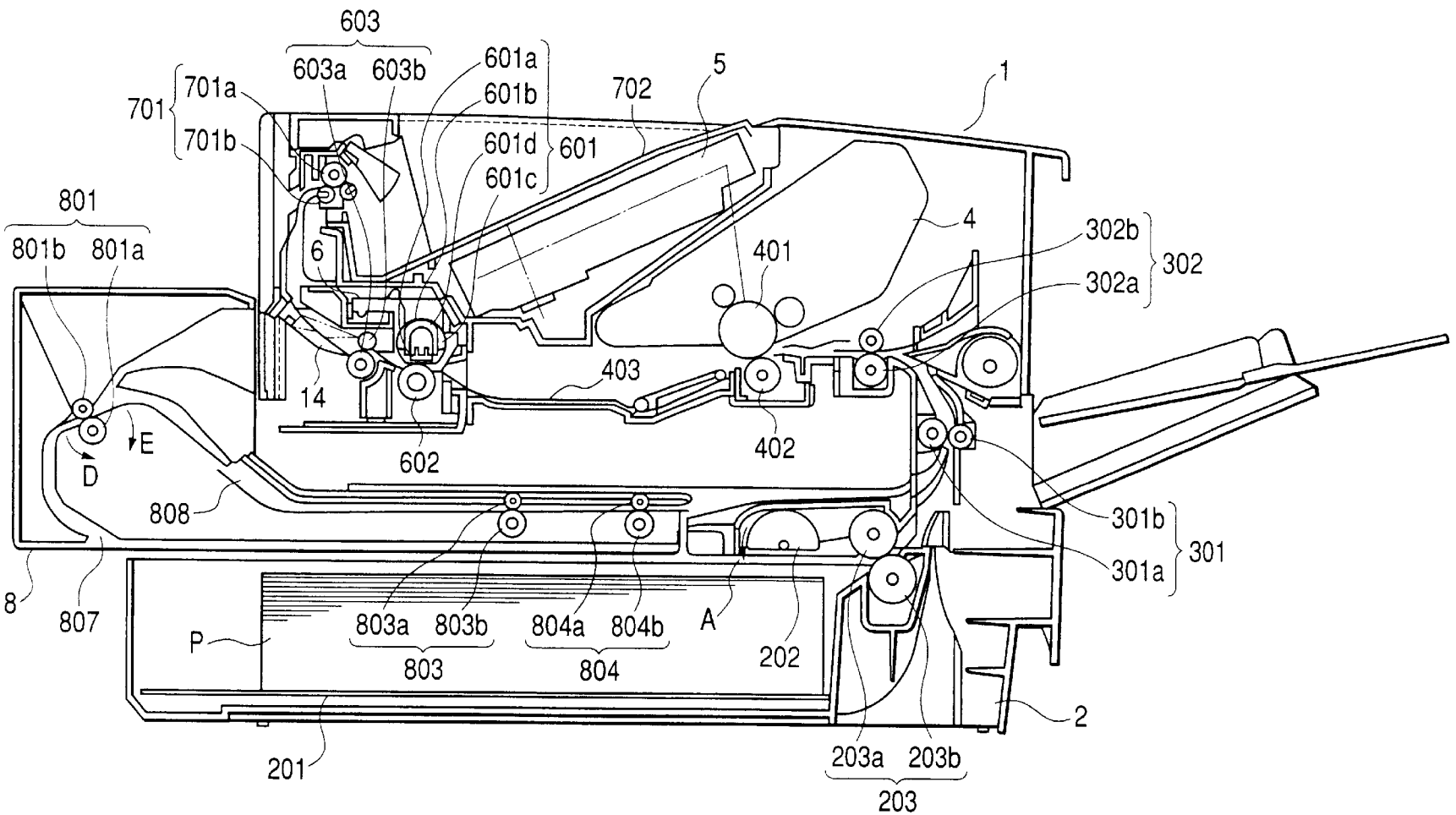
FIG. 1 is a cross-sectional view illustrating an image-forming apparatus.
Figure 2:
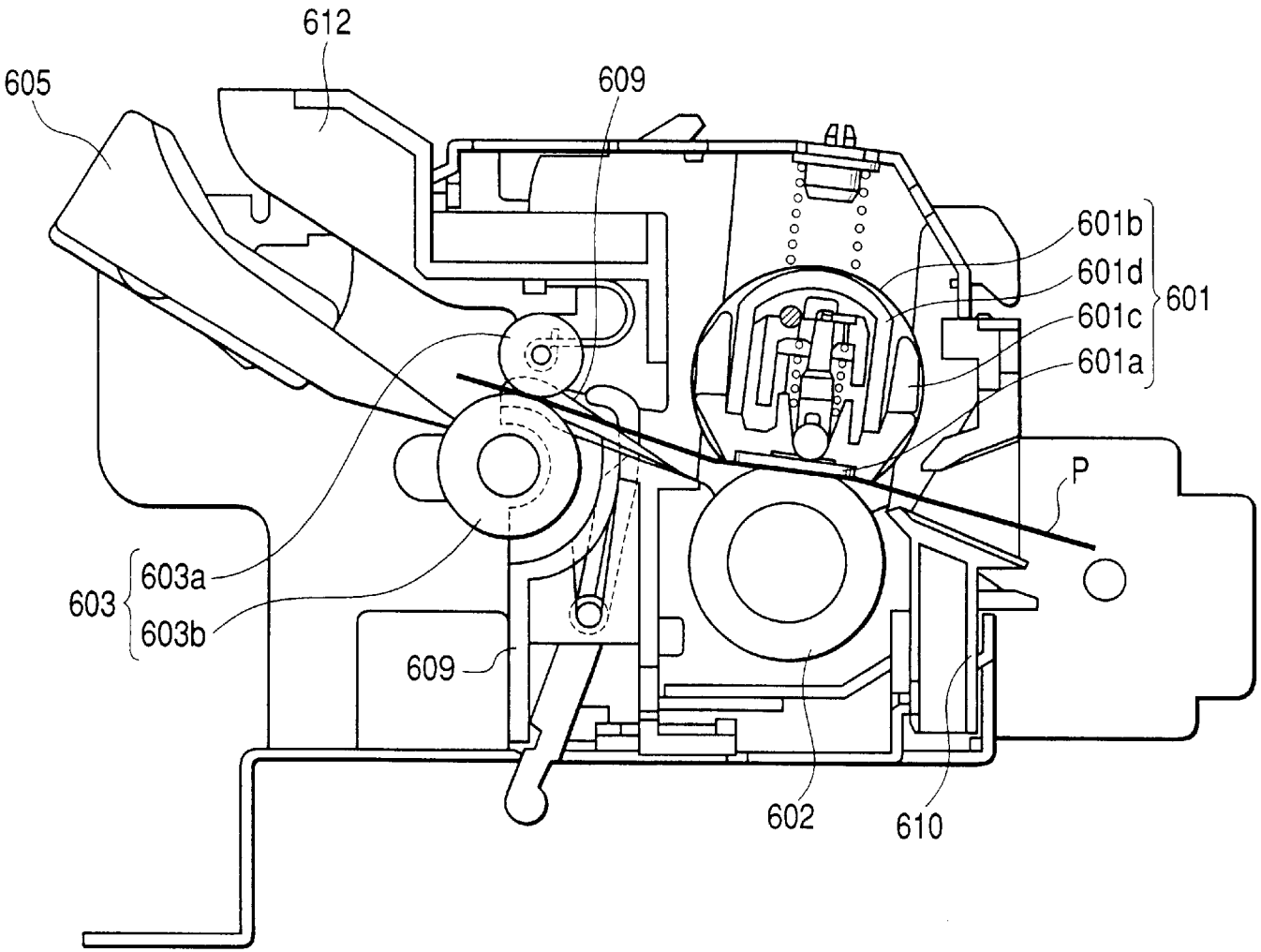
FIG. 2 is a cross-sectional view illustrating a fixing assembly.

The delivery guide member of the image-forming apparatus of the present invention may preferably be made of an antistatic polymer composition containing the following components (A) to (D).

(A): A polymer of at least one or any combination of two or more, selected from the group consisting of polyester, polycarbonate, polyamide, polyoxymethylene, polyphenylene sulfide, polyether imide, polyether ether ketone, polyketone, polysulfone, polyether sulfone, polyamide-imide, polyarylate, polyester carbonate, polyphenylene oxide, ABS resin, polystyrene, polypropylene, polyethylene, and olefin copolymers;

(B): a polyether type ion-conductive high polymer;

(C): at least one compound selected from the following compounds (I), (II) and (III) [provided that the compounds (I) and (II) are contained at the same time when the compound (III) is not contained] (hereinafter often "ion feed means"):

(I): at least one acid group feed source selected from the group consisting of a hydrocarbon acid having 7 to 54 carbon atoms, a sulfonic acid having 7 to 54 carbon atoms, an organic polymer having a carboxyl group, and an organic polymer having a sulfonic acid group;

(II): at least one metal ion feed source selected from the group consisting of a calcium ion, a copper ion, a sodium ion, a potassium ion, a lithium ion, a magnesium ion and a zinc ion, and capable of reacting with an acid group of the acid group feed source; and (III): at least one metal salt (the metal being selected from the group consisting of calcium, copper, sodium, potassium, lithium, magnesium and zinc) of at least one compound selected from the group consisting of a hydrocarbon acid having 7 to 54 carbon atoms, a sulfonic acid having 7 to 54 carbon atoms, an organic polymer having a carboxyl group, and an organic polymer having a sulfonic acid group; and (D) a plasticizer for the component-(B) polyether type ion-conductive high polymer.

The component-(B) polyether type ion-conductive high polymer may preferably be a polyether-ester amide.

The plasticizer for the component-(B) polyether type ion-conductive high polymer may preferably be a plasticizer represented by Formula (1) below.

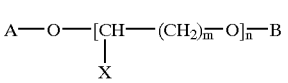

$$A-O-[CH(X)-(CH_2)_m-O]_n-B \quad (1)$$

wherein m represents an integer of 1 to 3, and n represents an integer of 4 to 25; A represents an alkyl, acyl or aroyl group having 1 to 10 carbon atoms; B represents an alkyl, acyl or aroyl group having 1 to 10 carbon atoms; and X represents H, $CH_3$ or $C_2H_5$.

In the present invention, the antistatic polymer composition that forms the delivery guide member may preferably contain the component-(A) polymer in an amount of from 40.0 to 98.4% by weight, the component-(B) polyether type ion-conductive high polymer from 1.0 to 35.0% by weight, the component (C) [at least one of the compounds (I), (II) and (III), provided that the compounds (I) and (II) are contained at the same time when the compound (III) is not contained] from 0.1 to 15.0% by weight, and the component-(D) plasticizer from 0.5 to 10.0% by weight, based on the total weight of the composition.

In the antistatic polymer composition that forms the delivery guide member, it is also effective to further contain a water repellent containing at least one constituent selected from the group consisting of a fluorine compound, a silicon compound, a compound formed by chemical combination of these, and a mixture of any of these.

The antistatic polymer composition comprises the matrix component-(A) polymer and mixed therein the component-(B) ion-conductive high polymer, the component-(C) ion feed means and the component-(D) plasticizer for the ion-conductive high polymer. Thus, ions can migrate freely and the surface resistivity of molded products can be controlled. This enables a delivery guide member having permanent antistatic properties to be formed.

In another embodiment of the present invention, the above-mentioned polymer composition may be mixed with the water repellent to impart water repellency to the delivery guide member molded from this polymer composition. This also brings about an improvement in its tack-free properties to unfixed toner images.

The component-(A) polymer is a polymer of at least one or any combination of two or more, selected from the group consisting of polyester, polycarbonate, polyamide, polyoxymethylene, polyphenylene sulfide, polyether imide, polyether ether ketone, polyketone, polysulfone, polyether sulfone, polyamide-imide, polyarylate, polyester carbonate, polyphenylene oxide, ABS resin, polystyrene, polypropylene, polyethylene, and olefin copolymers.

The polyester includes polyethylene terephthalate, obtained by polycondensation of ethylene glycol with terephthalic acid; polybutylene terephthalate, obtained by polycondensation of butanediol with terephthalic acid; and copolymers containing comonomer components other than these but having the physical and chemical properties of the polyethylene terephthalate or polybutylene terephthalate. Such comonomer components used to produce the copolymers may include glycol components such as ethylene glycol, 1,2-propylene glycol, pentanediol, hexanediol and 1,4-cyclohexane dimethanol; and dicarboxylic acid components such as isophthalic acid and napthalenedicarboxylic acid. The polyester may have an intrinsic viscosity of from 0.3 to 1.3, preferably from 0.5 to 1.0, and more preferably from 0.6 to 0.9. The polyester preferably used in the present invention is polyethylene terephthalate, polybutylene terephthalate or a mixture of these.

The polyester in the present invention may further include melt-processing polyesters or polyester amides that can form an anisotropic molten phase, which are commonly called thermotropic liquid-crystal polymers. Constituents of such polymers are aromatic hydroxycarboxylic acids, aromatic dicarboxylic acids, aliphatic dicarboxylic acids, aromatic diols, aliphatic diols, aromatic hydroxylamines or aromatic diamines. The melt-processing polyesters or polyester amides that can form an anisotropic molten phase are obtained by polymerizing one of these constituents or copolymerizing two or more constituents. Stated specifically, they may include aromatic polyesters obtained by polymerizing one or more of aromatic hydroxycarboxylic acids; aromatic polyesters obtained by polymerizing one or more of aliphatic dicarboxylic acids, an aromatic diol and one or more of aliphatic diols; aromatic polyesters composed chiefly of an aromatic hydroxycarboxylic acid and obtained by polymerizing one or more constituents selected from the group consisting of an aromatic dicarboxylic acids, an aliphatic dicarboxylic acid, an aromatic diol and an aliphatic diol; aromatic polyester amides obtained by polymerizing an aromatic hydroxylamine, one or more of aromatic diamines and one or more of aromatic hydroxycarboxylic acids; aromatic polyester amides obtained by polymerizing an aromatic hydroxylamine, one or more of aromatic diamines, one or more of aromatic hydroxycarboxylic acids, an aromatic dicarboxylic acid and one or more of aliphatic carboxylic acids; and aromatic polyester amides obtained by polymerizing an aromatic hydroxylamine, one or more of aromatic diamines, one or more of aromatic hydroxycarboxylic acids, an aromatic dicarboxylic acid, one or more of aliphatic carboxylic acids, an aromatic diol and one or more of aliphatic diols.

The aromatic hydroxycarboxylic acid may include, e.g., 4-hydroxybenzoic acid, 3-hydroxybenzoic acid, 2-hydroxybenzoic acid, 6-hydroxy-2-naphthoic acid, 5-hydroxy-2-naphthoic acid, and halogen-, alkyl- or allyl-substituted compounds of hydroxybenzoic acids. The aromatic dicarboxylic acid may include terephthalic acid, isophthalic acid, 3,3'-diphenyldicarboxylic acid, 4,4'-diphenyldicarboxylic acid, 1,4-naphthalenedicarboxylic acid, 1,5-naphthalenedicarboxylic acid, 2,6-naphthalenedicarboxylic acid, and alkyl- or halogen-substituted aromatic dicarboxylic acids such as t-butylterephthalic acid and chloroterephthalic acid. The aliphatic dicarboxylic acid may include cyclic aliphatic dicarboxylic acids such as trans-1,4-cyclohexanedicarboxylic acid, cis-1,4-cyclohexanedicarboxylic acid and 1,3-cyclohexanedicarboxylic acid, and substituted derivatives of these. The aromatic diol may include hydroquinone, biphenol, 4,4'-dihydroxydiphenyl ether, 3,4'-dihydroxydiphenyl ether, bisphenol-A, 3,4'-dihydroxydiphenyl methane, 3,3'-dihydroxydiphenyl methane, 4,4'-dihydroxydiphenyl sulfone, 3,4'-dihydroxydiphenyl sulfone, 4,4'-dihydroxydiphenyl sulfide, 3,4'-dihydroxydiphenyl sulfide, 2,6'-naphthalenediol, 1,6'-naphthalenediol, 4,4'-dihydroxybenzophenone, 3,4'-dihydroxybenzophenone, 3,3'-dihydroxybenzophenone, 4,4'-dihydroxydiphenyldimethylsilane, and alkyl- or halogen-substituted derivatives of these. The aliphatic diol may include cyclic, straight-chain or branched aliphatic diols such as trans-1,4-hexanediol, cis-1,4-hexanediol, trans-1,3-cyclohexanediol, cis-1,2-cyclohexanediol, ethylene glycol, 1,4-butanediol, 1,6-hexanediol, 1,8-hexanediol, trans-1,4-cyclohexanedimethanol, cis-1,4-cyclohexanedimethanol and cis-1,4-cyclohexanedimethanol, and substituted derivatives of these. The aromatic hydroxylamine or aromatic diamine may include, e.g., 4-aminophenol, 3-aminophenol, p-phenylenediamine, m-phenylenediamine, and substituted derivatives of these.

The liquid-crystal polymer used in the present invention may commonly have a number-average molecular weight of from about 2,000 to about 200,000, preferably from 5,000 to 50,000, and more preferably from 10,000 to 20,000. Liquid-crystal polymers preferably used in the present invention may include copolymers comprised of 4-hydroxybenzoic acid and 6-hydroxy-2-naphthoic acid, and copolymers comprised of any of hydroquinone, biphenol, 2,6-naphthalenedicarboxylic acid, terephthalic acid, 4-hydroxybenzoic acid and 6-hydroxy-2-naphthoic acid. Any of these may be used alone or in the form of a mixture of two or more types.

The other matrix polymer polyamide in the present invention is obtained by polycondensation of a constituent diamine with a constituent dicarboxylic acid. It may include polyamides obtained by polycondensation of at least one diamine selected from the group consisting of an aliphatic alkylene diamine, an aromatic diamine and an alicyclic alkylene diamine with at least one dicarboxylic acid selected from the group consisting of an aliphatic dicarboxylic acid, an aromatic dicarboxylic acid and an aromatic aminocarboxylic acid, and mixtures of these. The aliphatic alkylene diamine may be straight-chain or branched, and may specifically include ethylenediamine, trimethylenediamine, tetramethylenediamine, pentamethylenediamine, hexamethylenediamine, 1,7-diaminoheptane, 1,8-diaminooctane, 1,9-diaminononane, 1,10-diaminodecane, 2-methylpentamethylenediamine and 2-ethyltetramethylenediamine. Any of these aliphatic alkylene diamines may be used alone or in combination of two or more types. The aromatic diamine may be used alone or in combination of two or more types, and may include, e.g., para-phenylenediamine, ortho-phenylenediamine, meta-phenylenediamine, para-xylenediamine and meta-xylenediamine. The alicyclic alkylene diamine may specifically include 1,3-diaminocyclohexane, 1,4-diaminocyclohexane, 1,3-bis(aminomethyl)cyclohexane, bis(aminomethyl)cyclohexane, bis(4-aminocyclohexyl) methane, 4,4'-diamino-3,3'-dimethyldicyclohexylmethane, isophorone diamine, and piperazine; any of these may be used alone or in combination of two or more types. The aliphatic dicarboxylic acid may include adipic acid, sebacic acid, azelaic acid and dodecanoic diacid; any of these may be used alone or in combination of two or more types. The aromatic dicarboxylic acid may include, e.g., terephthalic acid, isophthalic acid, phthalic acid, 2-methylterephthalic acid and naphthalenedicarboxylic acid, and the aromatic aminocarboxylic acid may include, e.g., para-aminobenzoic acid; any of these aromatic monomers may be used alone or in combination of two or more types. Specific examples of the aminocarboxylic acid may include ϵ-aminocaproic acid and ω-aminoundecanoic acid, and any of these may be used alone or in combination of two or more types.

The above polyamide may have a number-average molecular weight of from 2,000 to 50,000, preferably from 5,000 to 40,000, and more preferably from 7,000 to 30,000. Polyamides preferably used in the present invention include nylon 66, nylon 6, a copolymer of nylon 66 and nylon 6, and mixtures of these.

The polycarbonate is obtained by a phosgene process in which bisphenol A is allowed to react with phosgene, or by mixing bisphenol A and diphenyl carbonate in an appropriate mixing ratio and heating and melting the mixture without use of any solvent to effect polycondensation by ester exchange reaction at a high temperature and under reduced pressure. The polycarbonate may have a number-average molecular weight of from 6,000 to 100,000, preferably from 10,000 to 80,000, and more preferably from 15,000 to 50,000.

The polyoxymethylene is obtained by polymerizing or copolymerizing, e.g., formaldehyde, a trioxane or tetraoxane which is a cyclic oligomer of formaldehyde, acetaldehyde or propyl aldehyde, or copolymerizing any of these aldehydes with a cyclic ether or cyclic acetal. The polyoxymethylene may have a number-average molecular weight of from 8,000 to 150,000, preferably from 12,000 to 100,000, and more preferably from 20,000 to 80,000.

The polyphenylene sulfide is obtained by allowing para-dichlorobenzene to react with sodium sulfide in a polar solvent. The polyphenylene sulfide may have a number-average molecular weight of from 5,000 to 90,000, preferably from 8,000 to 70,000, and more preferably from 10,000 to 60,000.

The component-(B) ion-conductive high polymer used in the present invention is a polyether type ion-conductive high polymer. The polyether has a good compatibility with the matrix polymer polyester or polyamide, and hence it can provide the surface of a molded product with antistatic effect. Stated specifically, it may include polyethylene oxide, polyether-ester amide, polyether amide-imide, ethylene oxide/epihalohydrin copolymers and methoxypolyethylene glycol/acrylate or methacrylate copolymers. It may preferably be a polyether having a low crystallinity, and particularly preferably be polyether-ester amide.

The polyether type ion-conductive high polymer may be contained in an amount of from 1.0 to 25.0% by weight, preferably from 3.0 to 20.0% by weight, and more preferably from 4.5 to 12.5% by weight, based on the weight of the polymer composition. If it is in an amount smaller than 1.0% by weight, the antistatic effect may be insufficient and the triboelectric voltage may exceed 500 V undesirably. If it is contained in an amount larger than 25.0% by weight, low mechanical properties may result.

The component-(C) ion feed means used in the present invention comprises at least one compound selected from the following compounds (I), (II) and (III) [provided that the compounds (I) and (II) are contained at the same time when the compound (III) is not contained]:

(I): at least one acid group feed source selected from the group consisting of a hydrocarbon acid having 7 to 54 carbon atoms, a sulfonic acid having 7 to 54 carbon atoms, an organic polymer having a carboxyl group, and an organic polymer having a sulfonic acid group;

(II): at least one metal ion feed source selected from the group consisting of a calcium ion, a copper ion, a sodium ion, a potassium ion, a lithium ion, a magnesium ion and a zinc ion, and capable of reacting with an acid group of the acid group feed source; and (III): at least one metal salt (the metal being selected from the group consisting of calcium, copper, sodium, potassium, lithium, magnesium and zinc) of at least one compound selected from the group consisting of a hydrocarbon acid having 7 to 54 carbon atoms, a sulfonic acid having 7 to 54 carbon atoms, an organic polymer having a carboxyl group, and an organic polymer having a sulfonic acid group.

Inasmuch as the component-(C) ion feed means is contained, ions can sufficiently be fed to the above-mentioned ion-conductive high polymer, and hence the ion-conductive high polymer can sufficiently exhibit the antistatic effect. The compound-(I) acid group feed source may be at least one acid group feed source selected from a hydrocarbon acid having 7 to 25 carbon atoms and an organic polymer having a pendant type carboxyl group. More preferably, it may be an ionomer comprised of an organic-ion hydrocarbon acid copolymer of an α-olefin having 2 to 5 carbon atoms and an α,β-ethylenically unsaturated carboxylic group of which has been neutralized with a sodium or potassium cation at least in part, which may preferably be used. Other suitable ionomers include (I) a polyethylene terephthalate and/or polybutylene terephthalate oligomer and (II) oligomer-like substances derived from a sodium and/or potassium ion feed source capable of reacting with a terminal carboxyl group.

The component-(C) ion feed means may be contained in an amount of from 0.1 to 15.0% by weight, preferably from 0.3 to 12.0% by weight, and more preferably from 1.0 to 8.0% by weight, based on the weight of the polymer composition. If it is in an amount smaller than 0.1% by weight, the antistatic effect may be insufficient and the triboelectric voltage may exceed 500 V undesirably. If it is contained in an amount larger than 15.0% by weight, low mechanical properties may result. The component-(C) ion feed means contains the metal ion feed source in a quantity sufficient for making metal concentration in the polymer composition higher than 1.0% by weight.

The component-(D) plasticizer used in the present invention has a plasticizing effect for the polyether type ion-conductive high polymer used. A preferable plasticizer is represented by Formula (1) below.

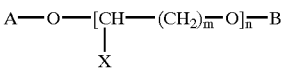

(1)

wherein m represents an integer of 1 to 3, and n represents an integer of 4 to 25; A represents an alkyl, acyl or aroyl group having 1 to 10 carbon atoms; B represents an alkyl, acyl or aroyl group having 1 to 10 carbon atoms; and X represents H, $CH_3$ or $C_2H_5$.

Inasmuch as the polymer composition of the present invention contains the plasticizer, ions can readily migrate under condition of high temperature. Hence, the higher the temperature conditions under which molded products are used are, the better antistatic effect can be exhibited. A preferred plasticizer is the one in which m is 1, n is 4 to 14 and X is H. A more preferred plasticizer is the one in which m is 1, or n is 7 to 13 or X is H, or A is acyl having 8 carbon atoms or methyl, or B is acyl having 8 carbon atoms, and, in particular, the one in which m is 1, n is 7 to 13, X is H, A is acyl having 8 carbon atoms or methyl, and B is acyl having 8 carbon atoms. As preferred specific examples, the plasticizer includes polyethylene glycol 400 bis(2-ethyl hexanoate), methoxypolyethylene glycol 550 2-ethyl hexanoate and tetraethylene glycol bis(2-ethyl hexanoate). In particular, polyethylene glycol 400 bis(2-ethyl hexanoate) may most preferably be used. The plasticizer may be contained in an amount of from 0.5 to 10.0% by weight, preferably from 1.0 to 8.0% by weight, and more preferably from 2.0 to 6.0% by weight, based on the weight of the polymer composition. If it is in an amount smaller than 0.5% by weight, the antistatic effect may be insufficient and the triboelectric voltage may exceed 500 V undesirably. If it is contained in an amount larger than 10.0% by weight, low mechanical properties may result.

The polymer composition of the present invention may be mixed with a known flame retardant. Stated specifically, it may include flame retardants such as polydibromostyrene, polytribromostyrene, polypentabromostyrene, decabromodiphenyl, tetrabromodiphenyl, hexabromodiphenyl ether, octabromodiphenyl ether, decabromodiphenyl ether, tetrabromodiphenyl sulfide, polypentabromobenzyl acrylate, brominated phenoxy resins, and epoxy-terminated phenoxy resins. It may preferably include epoxy-terminated phenoxy resins and brominated polystyrene. The flame retardant may usually be mixed in an amount of from 7 to 20% by weight based on the weight of the polymer composition. Together with the flame retardant, an antimony compound may be mixed which is known as an auxiliary flame retardant, such as antimony oxide or sodium antimonate.

In order to reinforce engineering plastics, a commonly available inorganic filler may also be compounded. The inorganic filler may specifically include glass fiber, carbon fiber, potassium titanate, whiskers, kaolin, clay, talc, wollastonite, calcium carbonate, silica and mica. Glass fiber may preferably be used. The inorganic filler may usually be compounded in an amount of from 5 to 60% by weight based on the weight of the polymer composition.

In addition to the components described above, the polymer composition of the present invention may also be compounded with commonly available additives such as an impact-resistant agent, a thermal stabilizer, an antioxidant, a dye, a pigment and a release agent.

The polymer composition of the present invention may be produced by any conventionally known methods. For example, the components may be melt-kneaded by means of a kneading apparatus such as a Banbury mixer, an extruder or a kneader of various types. Also, as for the order of kneading, the components may all be kneaded at a time, or the ion-conductive high polymer, the ion feed means and the plasticizer may be fed from a side feeder.

From the polymer composition of the present invention, molded products, such as the delivery guide member which guides the delivery of the transfer medium, positioned in the vicinity of the fixing assembly used in the image-forming apparatus such as copying machine and printers employing electrophotographic processes, can be produced by known methods such as injection molding.

EXAMPLES

The present invention will be described by giving Examples. The present invention is by no means limited to these Examples.

Example 1

A polymer composition comprised of the ingredients shown in Table 3 (Type A) was used in delivery guide members of the lower guide 609 and upper guide 612 for delivering the sheet material P toward the downstream side of the heater unit 601 and pressure roller 602.

The ingredients shown in Table 3 were melt-kneaded by means of a twin-screw extruder (ZSK-40, manufactured by W & P Corp.). The kneaded product was water-cooled and thereafter pellets were prepared. Using the pellets obtained, a test piece (100 mm×100 mm×3.2 mm) was molded. Mold temperature and resin temperature at the time of molding were 115° C. and 280° C., respectively.

Numerical values of the triboelectric voltage, surface resistivity and contact angle indicative of water repellency of the polymer composition (Type A) are also shown in Table 4 which were measured by the method prescribed in JIS L1094B, using the test piece thus obtained. As can be seen from Table 4, compared with the characteristics of the prior art (Type P) (see Table 2), Type A has features such that it shows a low value on the contact angle, but especially shows a low value on the triboelectric voltage.

The triboelectric voltage of the delivery guide members formed of the Type A composition was measured in the following way according to JIS L1094B.

Figure 3:
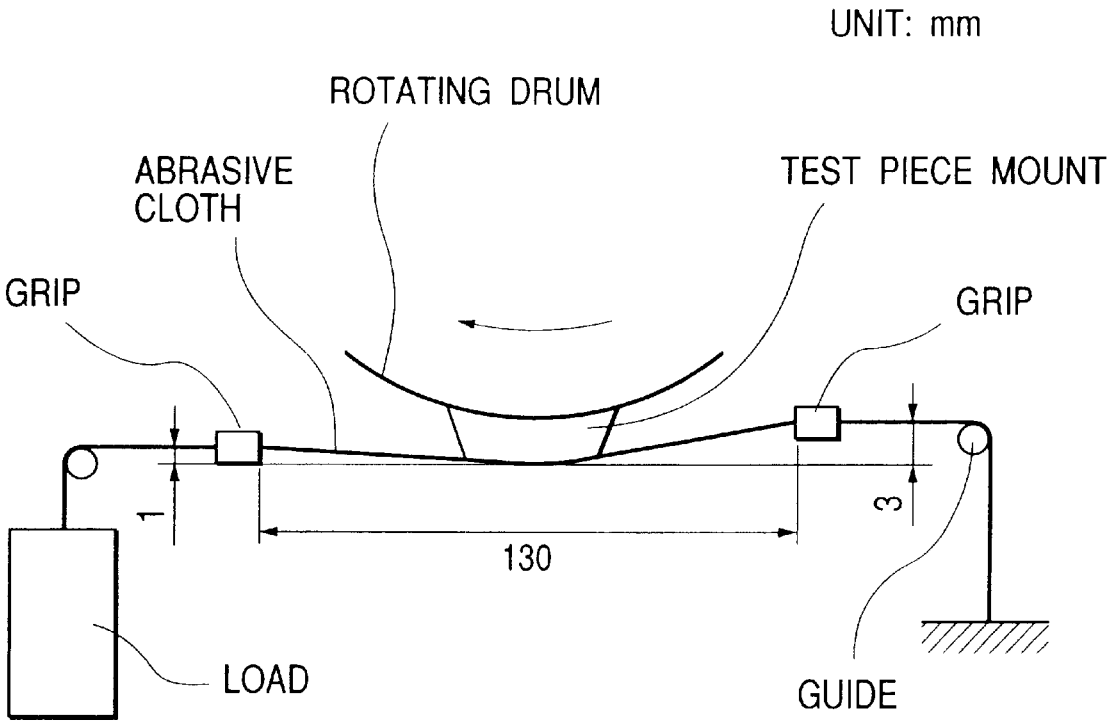
FIG. 3 is a schematic view of a triboelectric voltage measuring instrument.

FIG. 3 is a schematic view of a triboelectric voltage measuring instrument. A test-piece mount is provided on the surface of a rotating drum 150 mm in outer diameter. An abrasive cloth 25 mm wide and 150 mm long is held at both ends thereof by means of grips, and stretched with a load of 4,903 N so as to be brought into a positional relationship as shown in FIG. 3 in the state where the test piece is not set.

Figure 4:
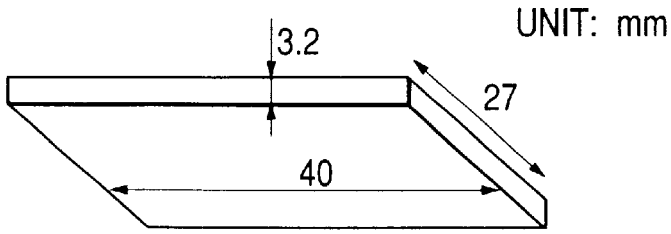
FIG. 4 illustrates a test piece for the measurement of triboelectric voltage.

As the abrasive cloth, a cotton cloth is used. This cotton cloth is a cloth having a warp of 20 tex, a weft of 16 tex, a warp density of 141 lines/5 cm, a weft density of 135 lines/5 cm and a weight (mass) of 100 g/m2. The cotton cloth is so disposed that its warps are perpendicular to the direction of friction. Next, a test piece as shown in FIG. 4 is cut out of the aformentioned test piece in a size of 40 mm×27 mm×3.2 mm and, using a fixture frame, is bent to form a curvature radius of 90 mm and set on the test piece mount. Then, in an atmosphere of 20° C. and 40% relative humidity, the rotating drum is rotated at a rotational speed of 400 rpm for 60 seconds to bring the test piece into friction with the abrasive cloth. The triboelectric voltage produced on the surface of the test piece as a result of the friction is measured. This is measured in the following way: A sensor is disposed at a distance of 15 mm from the test piece surface kept set on the test-piece mount, and the intensity of electric field is detected, which is then displayed on an oscilloscope to read a value of the triboelectric voltage produced on the test piece surface.

TABLE 3

| Type A | | |
|---|---|---|
| Trade name | Ingredient | wt. % |
| CRYSTAR TF3934 | PET | 42.5 |
| PELESTAT 6321 | PEEA | 4.3 |
| SURLYN 8920 | Ionomer | 3.6 |
| LIONON DEH 40 | Plasticizer | 1.5 |
| PPG 3540 | Glass fiber | 30 |
| IRGANOX 1010 | Antioxidant | 0.2 |
| SAYTEX HP7010 | Flame retardant | 16 |
| | Synergist ($Sb_2O_3$) | 1.9 |
| | | 100 |

CRYSTAR TF3934: available from Du Pont.

PELESTAT 6321: ethylene/methacrylic acid copolymer sodium-neutralized product available from Sanyo Chemical Industries, Ltd.

SURLYN 8920: available from Du Pont.

LIONON DEH 40: available from Lion Corporation, a plasticizer of the formula (1) in which X is H, m is 1, n is 8 to 10 (a mixture) and A and B are each

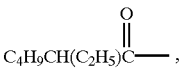

having an average molecular weight Mw of 680.

PPG 3540: available from PPG Industries, Inc.

IRGANOX 1010: available from Ciba-Geigy Corp.

SAYTEX HP7010: available from Albemare Co.

PET: polyethylene terephthalate

PEEA: polyether-ester amide

TABLE 4

| |
|---|
| Triboelectric voltage: 200 V |
| Surface resistivity: $5.2 \times 10^{12}$ Ω |
| Contact angle: 62° |

The results of an experiment for comparing the effect on toner adhesion in the present Example (Type A) with that in the prior art (Type P, Type P+UV coating) are also shown in Table 5. Evaluation of the effect was made according to five ranks as shown in Table 6.

TABLE 5

| | Upper guide | Lower guide |
|---|---|---|
| Type A: | AA | AA |
| Type P: | CC | CC |
| Type P + UV coating: | AA | AA |

Test Conditions

About 125,000 sheets were passed in double-side printing, using a laser beam printer (trade name: LBP1760; manufactured by CANON INC.). Printed pattern: vertical lines 0.4 mm in line width and 5 mm in line pitch.

The same test conditions applies in the following Examples.

TABLE 6

| Evaluation ranks | Adhesion of toner to upper and lower guides |
|---|---|
| AA: | No adhesion at all. The level of UV coating products. |
| A: | Almost no adhesion. |
| B: | Adhesion is seen a little, but neither image scrape nor paper jam occurs. |
| C: | Adhesion is seen. The level of damaging sheet materials and causing image scrape. No paper jamming occurs. |
| CC: | Adhesion is seen. The level of damaging sheet materials and causing image scraping and paper jamming. |

The same evaluation ranks applies in the following Examples.

As can be seen from Table 5, in the case of Type A of the present Example, any toner adhesion is not seen even when the UV coating is not applied.

Besides the upper guide and lower guide, Type A of the present Example may also be used in an entrance guide 610 which guides the sheet material to the heater unit 601 and pressure roller 602 and also in the flap 605 which changes the sheet material delivery direction after fixing.

Example 2

In Example 1, a polymer composition comprised of the ingredients shown in Table 7 (Type B) was used as a material for the delivery guide members.

Numerical values of the triboelectric voltage, surface resistivity and contact angle indicative of water repellency of a test piece formed using the polymer composition (Type B) are shown in Table 8. As can be seen from Table 8, compared with the characteristics of the prior art (Type P) (see Table 2), Type B has features such that it shows a low value on the contact angle, but especially shows a low value on the triboelectric voltage.

TABLE 7

| Type B | | |
|---|---|---|
| Trade name | Ingredient | wt. % |
| CRYSTAR TF3934 | PET | 41.3 |
| PELESTAT 6321 | PEEA | 5.5 |
| SURLYN 8920 | Ionomer | 3.6 |
| LIONON DEH 40 | Plasticizer | 1.5 |
| PPG 3540 | Glass fiber | 30 |
| IRGANOX 1010 | Antioxidant | 0.2 |
| SAYTEX HP7010 | Flame retardant | 16 |
| | Synergist ($Sb_2O_3$) | 1.9 |
| | | 100 |

TABLE 8

| |
|---|
| Triboelectric voltage: 55 V |
| Surface resistivity: $1.6 \times 10^{11}$ Ω |
| Contact angle: 60° |

The results of an experiment for comparing the effect against toner adhesion in the present Example (Type B) with that in the prior art (Type P, Type P+UV coating) are also shown in Table 9.

TABLE 9

| | Upper guide | Lower guide |
|---|---|---|
| Type B: | A | AA |
| Type P: | CC | CC |
| Type P + UV coating: | AA | AA |

As can be seen from Table 9, also in the case of Type B of the present Example, the toner adhesion is hardly seen even when the UV coating is not applied. Other results are the same as those in Example 1.

Example 3

In Example 1, a polymer composition comprised of the ingredients shown in Table 10 (Type C) was used as a material for the delivery guide members.

Numerical values of the triboelectric voltage, surface resistivity and contact angle indicative of water repellency of a test piece formed using the polymer composition (Type C) are shown in Table 11. As can be seen from Table 11, compared with the characteristics of the prior art (Type P) (see Table 2), Type C has features such that it shows a low value on the contact angle, but especially shows a low value on the triboelectric voltage.

TABLE 10

Type C

| Trade name | Ingredient | wt. % |
|---|---|---|
| CRYSTAR TF3934 | PET | 40.8 |
| PELESTAT 6321 | PEEA | 6 |
| SURLYN 8920 | Ionomer | 3.6 |
| LIONON DEH 40 | Plasticizer | 1.5 |
| PPG 3540 | Glass fiber | 30 |
| IRGANOX 1010 | Antioxidant | 0.2 |
| SAYTEX HP7010 | Flame retardant | 16 |
| | Synergist ($Sb_2O_3$) | 1.9 |
| | | 100 |

TABLE 11

| |
|---|
| Triboelectric voltage: 30 V |
| Surface resistivity: $0.8 \times 10^{10}$ Ω |
| Contact angle: 58° |

The results of an experiment for comparing the effect against toner adhesion in the present Example (Type C) with that in the prior art (Type P, Type P+UV coating) are shown in Table 12.

TABLE 12

| | Upper guide | Lower guide |
|---|---|---|
| Type B: | AA | A |
| Type P: | CC | CC |
| Type P + UV coating: | AA | AA |

As can be seen from Table 12, also in the case of Type C of the present Example, the toner adhesion is little seen even when the UV coating is not applied. Other results are the same as those in Example 1.

Example 4

In Example 1, a polymer composition comprised of the ingredients shown in Table 13 (Type D) was used as a material for the delivery guide members. What differs from Examples 1 to 3 is that a water repellent (TEFLON MP1500, polytetrafluoroethylene powder) was added.

Numerical values of the triboelectric voltage, surface resistivity and contact angle indicative of water repellency of a test piece formed using the polymer composition (Type D) are shown in Table 14. As can be seen from Table 14, Type D has features such that it shows substantially the same contact angle as the contact angle attained when the UV coating is applied to the prior art (Type P) and shows a lower value on the triboelectric voltage than the characteristics of the prior art (Type P) (see Table 2) like Examples 1 to 3.

TABLE 13

Type D

| Trade name | Ingredient | wt. % |
|---|---|---|
| CRYSTAR TF3934 | PET | 30.8 |
| PELESTAT 6321 | PEEA | 6 |
| SURLYN 8920 | Ionomer | 3.6 |
| LIONON DEH 40 | Plasticizer | 1.5 |
| TEFLON MP 1500 | Teflon | 10 |
| PPG 3540 | Glass fiber | 30 |
| IRGANOX 1010 | Antioxidant | 0.2 |
| SAYTEX HP7010 | Flame retardant | 16 |
| | Synergist ($Sb_2O_3$) | 1.9 |
| | | 100 |

TEFLON MP 1500: available from Du Pont.

TABLE 14

| |
|---|
| Triboelectric voltage: 200 V |
| Surface resistivity: $8.6 \times 10^{12}$ Ω |
| Contact angle: 98° |

The results of an experiment for comparing the effect against toner adhesion in the present Example (Type D) with that in the prior art (Type P, Type P+UV coating) are shown in Table 15.

TABLE 15

| | Upper guide | Lower guide |
|---|---|---|
| Type B: | B | B |
| Type P: | CC | CC |
| Type P + UV coating: | AA | AA |

As can be seen from Table 15, also in the case of Type D of the present Example, results better than those of Type P (the prior art) are obtained even when the UV coating is not applied, and neither image scraping nor paper jamming occurs. Other results are the same as those in Example 1.

Example 5

In Example 1, a polymer composition comprised of the ingredients shown in Table 16 (Type E) was used as a material for the delivery guide members. What differs from Examples 1 to 3 is that a water repellent (silicone gum) was added.

Numerical values of the triboelectric voltage, surface resistivity and contact angle indicative of water repellency of a test piece formed using the polymer composition (Type E) are also shown in Table 17. As can be seen from Table 17, Type E has features such that it shows substantially the same contact angle as the contact angle attained when the UV coating is applied to the prior art (Type P) and shows a lower value on the triboelectric voltage than the characteristics of the prior art (Type P) (see Table 2) like Examples 1 to 3.

TABLE 16

| Type E | | |
|---|---|---|
| Trade name | Ingredient | wt. % |
| CRYSTAR TF3934 | PET | 38.8 |
| PELESTAT 6321 | PEEA | 6.5 |
| SURLYN 8920 | Ionomer | 3.6 |
| LIONON DEH 40 | Plasticizer | 1.5 |
| BY27-009 | Silicone gum | 1.5 |
| PPG 3540 | Glass fiber | 30 |
| IRGANOX 1010 | Antioxidant | 0.2 |
| SAYTEX HP7010 | Flame retardant | 16 |
| | Synergist ($Sb_2O_3$) | 1.9 |
| | | 100 |

DY27-009: available from Toray Dow Silicone, Inc.

TABLE 17

| |
|---|
| Triboelectric voltage: 25 V |
| Surface resistivity: $1.6 \times 10^{11}$ Ω |
| Contact angle: 105° |

The triboelectric voltage of the delivery guide members of the lower guide 609 and upper guide 612, molded using the Type E antistatic polymer composition in the present Example, was as low as 25 V, which was so low that comparison with the prior art Type P is not necessary. Also, it was lower than the case when the Type D antistatic polymer composition of Example 4 was used. Hence, the effect on toner adhesion to the delivery guide members was expected to be on the level equal to or higher than that of Example 4. Accordingly, the experiment for the comparison with the prior art Type P or Type P+UV coating was not made here.

Example 6

In Example 1, a polymer composition comprised of the ingredients shown in Table 18 (Type F) was used as a material for the delivery guide members.

Numerical values of the triboelectric voltage, surface resistivity and contact angle indicative of water repellency of a test piece formed using the polymer composition (Type F) are shown in Table 19. As can be seen from Table 19, Type F has features such that it shows a lower value on the contact angle than that of the prior art (Type P), but shows a lower value on the triboelectric voltage than the characteristics of the prior art (Type P) (see Table 2).

TABLE 18

| Type F | | |
|---|---|---|
| Trade name | Ingredient | wt. % |
| CRYSTAR TF3934 | PET | 42.7 |
| PELESTAT 6321 | PEEA | 4.1 |
| SURLYN 8920 | Ionomer | 3.6 |
| LIONON DEH 40 | Plasticizer | 1.5 |
| PPG 3540 | Glass fiber | 30 |
| IRGANOX 1010 | Antioxidant | 0.2 |
| SAYTEX HP7010 | Flame retardant | 16 |
| | Synergist ($Sb_2O_3$) | 1.9 |
| | | 100 |

TABLE 19

| |
|---|
| Triboelectric voltage: 280 V |
| Surface resistivity: $8.7 \times 10^{12}$ Ω |
| Contact angle: 65° |

The results of an experiment for comparing the effect on toner adhesion in the present Example (Type F) with that in the prior art (Type P, Type P+UV coating) are shown in Table 20.

TABLE 20

| | Upper guide | Lower guide |
|---|---|---|
| Type F: | B | B |
| Type P: | CC | CC |
| Type P + UV coating: | AA | AA |

As can be seen from Table 15, also in the case of Type F of the present Example, results better than those of Type P (the prior art) are obtained even when the UV coating is not applied, and neither image scraping nor paper jamming occurs. Other results are the same as those in Example 1.

Example 7

In Example 1, a polymer composition comprised of the ingredients shown in Table 21 (Type G) was used as a material for the delivery guide members.

Numerical values of the triboelectric voltage, surface resistivity and contact angle indicative of water repellency of a test piece formed using the polymer composition (Type G) are shown in Table 22. As can be seen from Table 22, Type G has features such that it shows a lower value on the contact angle than that of the prior art (Type P), but shows a lower value on the triboelectric voltage than the characteristics of the prior art (Type P) (see Table 2).

TABLE 21

| Type G | | |
|---|---|---|
| Trade name | Ingredient | wt. % |
| CRYSTAR TF3934 | PET | 39.9 |
| Carbon Black | Conductive powder | 10.0 |
| Talc FFR | Talc | 0.5 |
| LIONON DEH 40 | Plasticizer | 1.5 |
| PPG 3540 | Glass fiber | 30 |
| IRGANOX 1010 | Antioxidant | 0.2 |
| SAYTEX HP7010 | Flame retardant | 16 |
| | Synergist ($Sb_2O_3$) | 1.9 |
| | | 100 |

Talc FFR: available from Asada Milling Co., Ltd.

TABLE 22

| |
|---|
| Triboelectric voltage: 30 V |
| Surface resistivity: $5.6 \times 10^9$ Ω |
| Contact angle: 65° |

The results of an experiment for comparing the effect on toner adhesion in the present Example (Type G) with that in the prior art (Type P, Type P+UV coating) are shown in Table 23.

TABLE 23

| | Upper guide | Lower guide |
|---|---|---|
| Type G: | A | A |
| Type P: | CC | CC |
| Type P + UV coating: | AA | AA |

As can be seen from Table 23, also in the case of Type G of the present Example, results better than those of Type P (the prior art) are obtained even when the UV coating is not applied, and neither image scraping nor paper jamming occurs. Other results are the same as those in Example 1.

Example 8

In Example 1, a polymer composition comprised of the ingredients shown in Table 24 (Type H) was used as a material for the delivery guide members.

Numerical values of the triboelectric voltage, surface resistivity and contact angle indicative of water repellency of a test piece formed using the polymer composition (Type H) are shown in Table 25. As can be seen from Table 25, Type H has features such that it shows a lower value on the contact angle than that of the prior art (Type P), but shows a lower value on the triboelectric voltage than the characteristics of the prior art (Type P) (see Table 2).

TABLE 24

| Type H | | |
|---|---|---|
| Trade name | Ingredient | wt. % |
| CRYSTAR TF3934 | PET | 48.9 |
| CHEMISTAT 3033 | Surfactant | 1.0 |
| Talc FFR | Talc | 0.5 |
| LIONON DEH 40 | Plasticizer | 1.5 |
| PPG 3540 | Glass fiber | 30 |
| IRGANOX 1010 | Antioxidant | 0.2 |
| SAYTEX HP7010 | Flame retardant | 16 |
| | Synergist ($Sb_2O_3$) | 1.9 |
| | | 100 |

CHEMISTAT 3033: available from Sanyo Chemical Industries, Ltd.

TABLE 25

| |
|---|
| Triboelectric voltage: 270 V |
| Surface resistivity: $3.6 \times 10^{12}$ Ω |
| Contact angle: 48° |

The results of an experiment for comparing the effect on toner adhesion in the present Example (Type H) with that in the prior art (Type P, Type P+UV coating) are shown in Table 26.

TABLE 26

| | Upper guide | Lower guide |
|---|---|---|
| Type H: | B | B |
| Type P: | CC | CC |
| Type P + UV coating: | AA | AA |

As can be seen from Table 26, also in the case of Type H of the present example, results better than those of Type P (the prior art) are obtained even when the UV coating is not applied, and neither image scraping nor paper jamming occurs. Other results are the same as those in Example 1.

Example 9

In Example 1, a polymer composition comprised of the ingredients shown in Table 27 (Type I) was used as a material for the delivery guide members.

Numerical values of the triboelectric voltage, surface resistivity and contact angle indicative of water repellency of a test piece formed using the polymer composition (Type I) are shown in Table 28. As can be seen from Table 28, Type I has features such that it shows a lower value on the contact angle than that of the prior art (Type P), but shows a lower value on the triboelectric voltage than the characteristics of the prior art (Type P) (see Table 2).

TABLE 27

| Type I | | |
|---|---|---|
| Trade name | Ingredient | wt. % |
| CRYSTAR TF3934 | PET | 44.9 |
| DIALEAD 223SE | Carbon fiber | 5.0 |
| Talc FFR | Talc | 0.5 |
| LIONON DEH 40 | Plasticizer | 1.5 |
| PPG 3540 | Glass fiber | 30 |
| IRGANOX 1010 | Antioxidant | 0.2 |
| SAYTEX HP7010 | Flame retardant | 16 |
| | Synergist ($Sb_2O_3$) | 1.9 |
| | | 100 |

DIALEAD 223SE: available from Mitsubishi Chemical Co., Ltd.

TABLE 28

| |
|---|
| Triboelectric voltage: 18 V |
| Surface resistivity: $1.9 \times 10^5$ Ω |
| Contact angle: 68° |

The results of an experiment for comparing the effect against toner adhesion in the present Example (Type I) with that in the prior art (Type P, Type P+UV coating) are shown in Table 29.

TABLE 29

| | Upper guide | Lower guide |
|---|---|---|
| Type I: | A | A |
| Type P: | CC | CC |
| Type P + UV coating: | AA | AA |

As can be seen from Table 29, in the case of Type I of the present Example, too, results better than those of Type P (the prior art) are obtained even when the UV coating is not applied, and neither image scraping nor paper jamming occurs. Other results are the same as those in Example 1.

What is claimed is:

1. An image-forming apparatus in which, using a photosensitive member and a toner, an unfixed image of the toner is formed on a transfer medium, and the unfixed image on the transfer medium is fixed by a heat-and-pressure fixing means, wherein;

a delivery guide member, which guides a delivery of the transfer medium, is positioned in a vicinity of the heat-and-pressure fixing means;

wherein said delivery guide member is formed of an antistatic polymer composition, is free of a surface coating for preventing the toner from adhering to said delivery guide member, and has a value of triboelectric voltage not greater than 500 V as measured by the triboelectric voltage measuring method according to JIS L1094B.

2. The image-forming apparatus according to claim 1, wherein said delivery guide member has a value of triboelectric voltage not greater than 280 V.

3. An image-forming apparatus in which, using a photosensitive member and a toner, an unfixed image of the toner is formed on a transfer medium, and the unfixed image on the transfer medium is fixed by a heat-and-pressure fixing means, wherein a delivery guide member, which guides a delivery of the transfer medium, is positioned in a vicinity of the heat-and-pressure fixing means, has a value of triboelectric voltage not greater than 500 V as measured by a triboelectric voltage measuring method according to JIS L1094B, wherein said delivery guide member is formed of an antistatic polymer composition containing the following components (A) to (D):

(A): a polymer of at least one or any combination of two or more, selected from a group consisting of polyester, polycarbonate, polyamide, polyoxymethylene, polyphenylene sulfide, polyether imide, polyether ether ketone, polyketone, polysulfone, polyether sulfone, polyamide-imide, polyarylate, polyester carbonate, polyphenylene oxide, ABS resin, polystyrene, polypropylene, polyethylene, and olefin copolymers;

(B): a polyether type ion-conductive high polymer;

(C): at least one compound selected from the following compounds (I), (II) and (III) provided that said compounds (I) and (II) are contained at the same time when said compound (III) is not contained: (I): at least one acid group feed source selected from a group consisting of a hydrocarbon acid having 7 to 54 carbon atoms, a sulfonic acid having 7 to 54 carbon atoms, an organic polymer having a carboxyl group, and an organic polymer having a sulfonic acid group; (II): at least one metal ion feed source selected from a group consisting of a calcium ion, a copper ion, a sodium ion, a potassium ion, a lithium ion, a magnesium ion, and a zinc ion, and capable of reacting with an acid group of the acid group feed source; and (III): at least one metal salt (the metal being selected from the group consisting of calcium, copper, sodium, potassium, lithium, magnesium, and zinc) of at least one compound selected from the group consisting of a hydrocarbon acid having 7 to 54 carbon atoms, a sulfonic acid having 7 to 54 carbon atoms, an organic polymer having a carboxyl group, and an organic polymer having a sulfonic acid group; and (D): a plasticizer for said component-(B) polyether type ion-conductive high polymer.

4. The image-forming apparatus according to claim 3, wherein said component-(B) polyether type ion-conductive high polymer is a polyether-ester amide.

5. The image-forming apparatus according to claim 3 or 4, wherein said plasticizer for said component-(B) polyether type ion-conductive high polymer is a plasticizer represented by the following formula:

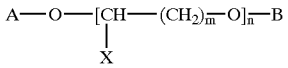

[(1)]

wherein m represents an integer of 1 to 3, and n represents an integer of 4 to 25; A represents an alkyl, acyl, or aroyl group having 1 to 10 carbon atoms; B represents an alkyl, acyl, or aroyl group having 1 to 10 carbon atoms; and X represents H, $CH_3$, or $C_2H_5$.

6. The image-forming apparatus according to claim 3 or 4, wherein said antistatic polymer composition, which forms said delivery guide member contains said component-(A) polymer in an amount of from 40.0 to 98.4% by weight, said component-(B) polyether type ion-conductive high polymer from 1.0 to 35.0% by weight, said component (C) from 0.1 to 15.0% by weight, and said component-(D) plasticizer from 0.5 to 10.0% by weight, based on a total weight of said antistatic polymer composition.

7. The image-forming apparatus according to claim 5, wherein said antistatic polymer composition, which forms said delivery guide member contains said component-(A) polymer in an amount of from 40.0 to 98.4% by weight, said component-(B) polyether type ion-conductive high polymer from 1.0 to 35.0% by weight, said component (C) from 0.1 to 15.0% by weight, and said component-(D) plasticizer from 0.5 to 10.0% by weight, based on a total weight of the composition.

8. The image-forming apparatus according to claim 3 or 4, wherein said antistatic polymer composition, which forms said delivery guide member further contains a water repellent containing at least one constituent selected from a group consisting of a fluorine compound, a silicon compound, a compound formed by chemical combination of said constituents, and a mixture of any of said constituents.

9. The image-forming apparatus according to claim 5, wherein said antistatic polymer composition, which forms said delivery guide member further contains a water repellent containing at least one constituent selected from a group consisting of a fluorine compound, a silicon compound, a compound formed by chemical combination of said constituents, and a mixture of any of said constituents.

10. The image-forming apparatus according to claim 1, wherein said delivery guide member is formed by molding said antistatic polymer composition.

* * * * *

UNITED STATES PATENT AND TRADEMARK OFFICE

CERTIFICATE OF CORRECTION

PATENT NO. : 6,556,797 B1 
DATED : April 29, 2003
INVENTOR(S) : Makoto Nishigaki et al.

It is certified that error appears in the above-identified patent and that said Letters Patent is hereby corrected as shown below:

Column 1,
Line 15, “materials” should read -- material --.

Column 2,
Line 24, “angle” should read -- angle indicative of --.

Column 12,
Line 9, “Conditions” should read -- Conditions: --.

Column 19,
Line 18, “means, wherein;” should read -- means, --;
Line 19, “a delivery” should read -- wherein a delivery --; and
Line 21, “means;” should read -- means, and --.

Column 20,
Line 16, “[(1)]” should be deleted.

Signed and Sealed this

Twenty-fifth Day of November, 2003

JAMES E. ROGAN
*Director of the United States Patent and Trademark Office*